US008342080B2

(12) United States Patent
Richardson et al.

(10) Patent No.: US 8,342,080 B2
(45) Date of Patent: Jan. 1, 2013

(54) PROGRAMMABLE COOKING SYSTEM AND METHOD

(76) Inventors: Steven M. Richardson, Sarepta, LA (US); R. Keith Harrison, Shreveport, LA (US)

( * ) Notice: Subject to any disclaimer, the term of this patent is extended or adjusted under 35 U.S.C. 154(b) by 504 days.

(21) Appl. No.: 12/592,893

(22) Filed: Dec. 4, 2009

(65) Prior Publication Data

US 2011/0132201 A1 Jun. 9, 2011

(51) Int. Cl.

| | |
|---|---|
| ***F24C 7/02*** | (2006.01) |
| ***F24C 15/16*** | (2006.01) |
| ***A21B 1/40*** | (2006.01) |
| ***A21B 1/50*** | (2006.01) |

(52) U.S. Cl. ..... 99/328; 99/329 R; 99/332; 99/333; 99/339; 219/393; 219/396; 219/489; 126/337 R; 126/332

(58) Field of Classification Search ..... 99/325, 99/326, 327, 328, 329 R, 331, 332, 333, 339; 219/393, 396, 398, 400, 411, 413, 489, 681, 219/685; 126/337 R, 332, 337 A, 339, 39 BA, 126/39 J, 39 H See application file for complete search history.

(56) References Cited

U.S. PATENT DOCUMENTS

| | | | | |
|---|---|---|---|---|
| 5,746,114 | A * | 5/1998 | Harris | 99/331 |
| 6,587,739 | B1 * | 7/2003 | Abrams et al. | 700/83 |
| 6,815,644 | B1 * | 11/2004 | Muegge et al. | 219/393 |
| 7,092,988 | B1 * | 8/2006 | Bogatin et al. | 709/203 |
| 8,047,128 | B2 * | 11/2011 | Salvaro | 99/352 |
| 2004/0134903 | A1 * | 7/2004 | Chun | 219/708 |
| 2011/0151072 | A1 * | 6/2011 | Anderson et al. | 426/231 |

* cited by examiner

*Primary Examiner* — Reginald L Alexander
(74) *Attorney, Agent, or Firm* — R. Keith Harrison

(57) ABSTRACT

A programmable cooking system includes a controller, at least one of a cooking range and an oven interfacing with the controller, a set of scales interfacing with the controller, a timer interfacing with the controller and at least one data entry component interfacing with the controller.

4 Claims, 6 Drawing Sheets

PROGRAMMABLE COOKING SYSTEM AND METHOD

FIELD

The disclosure generally relates to systems and method for cooking foods. More particularly, the disclosure relates to a programmable cooking system which can be programmed to facilitate cooking of foods according to precise recipe requirements and further relates to a programmable cooking method.

BACKGROUND

Cooking is a popular pastime which is enjoyed by millions of people around the world. In the preparation of foods for consumption, cooks select, process, combine and typically heat a variety of ingredients using a variety of tools and methods. The food preparation process is often considered an art form in which the flavor, texture and appearance of a mixture of ingredients is transformed into a food or dish having an appetizing appearance with a flavor and texture that are appealing and pleasant to the taste.

Foods which are prepared for consumption using conventional cooking methods range from meats such as steak, chicken and fish to desserts such as cakes and pies. These foods are usually prepared according to a recipe, which is a set of instructions that specifies which ingredients are to be used in preparation of the food as well as the quantities of the ingredients; the conditions and tools which are to be used for processing each ingredient prior to mixing of the ingredients; the times and temperatures at which the ingredients are to be subjected to heat; and post-heating requirements or suggestions such as chilling or the addition of toppings and other taste-enhancing foods, spices or condiments to the cooked food. Experienced cooks may vary these parameters to produce a food having a taste and/or texture which may differ from that which would result from strictly following the recipe.

As many cooks have learned by experience, two people can prepare the same food according to the same recipe with different results. Some persons may seem to have a "knack" for combining the ingredients in a certain manner to achieve a result which is superior to that which is obtained by others. Additionally, a person may prepare food according to the same recipe more than once with different results each time. The variations in taste and texture may be due to minor and imperceptible differences in preparation of the foods each time. Moreover, inexperienced cooks may have a tendency to undercook or overcook foods.

Accordingly, a programmable cooking system which can be programmed to facilitate cooking of foods according to precise recipe requirements is needed to enable optimum and repeatable preparation of a variety of foods irrespective of the ability or experience of the food preparer.

SUMMARY

The disclosure is generally directed to a programmable cooking system. An illustrative embodiment of the programmable cooking system includes a controller, at least one of a cooking range and an oven interfacing with the controller, a set of scales interfacing with the controller, a timer interfacing with the controller and at least one data entry component interfacing with the controller.

In some embodiments, the programmable cooking system may include a controller having a database and at least one of a cooking range and an oven. The cooking range may include a cooking range housing, at least one set of scales carried by the cooking range housing and interfacing with the controller and at least one cooking range burner carried by the at least one set of scales, respectively, and connected to the controller. The oven may include an oven housing having an oven housing interior, at least one oven rack selectively extendable from the oven housing interior, at least one set of scales carried by the at least one oven rack and interfacing with the controller and at least one heating element provided in the oven housing interior and connected to the controller. A timer and at least one data entry component may interface with the controller.

In some embodiments, the programmable cooking system may include a controller having a database; a display monitor interfacing with the controller; a cooking range comprising a cooking range housing having a keyboard slot; a keyboard support selectively extendable from the cooking range housing through the keyboard slot; a keyboard interfacing with the controller and carried by the keyboard support; at least one set of scales carried by the cooking range housing and interfacing with the controller; and at least one cooking range burner carried by the at least one set of scales, respectively, and connected to the controller; an oven comprising an oven housing having an oven housing interior; at least one oven rack selectively extendable from the oven housing interior; at least one set of scales carried by the at least one oven rack and interfacing with the controller; and at least one heating element provided in the oven housing interior and connected to the controller; a timer interfacing with the controller; and at least one of a media drive and a communication network having a user interface interfacing with the controller.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Furthermore, there is no intention to be bound by any expressed or implied theory presented in the preceding technical field, background, brief summary or the following detailed description.

Figure 1:
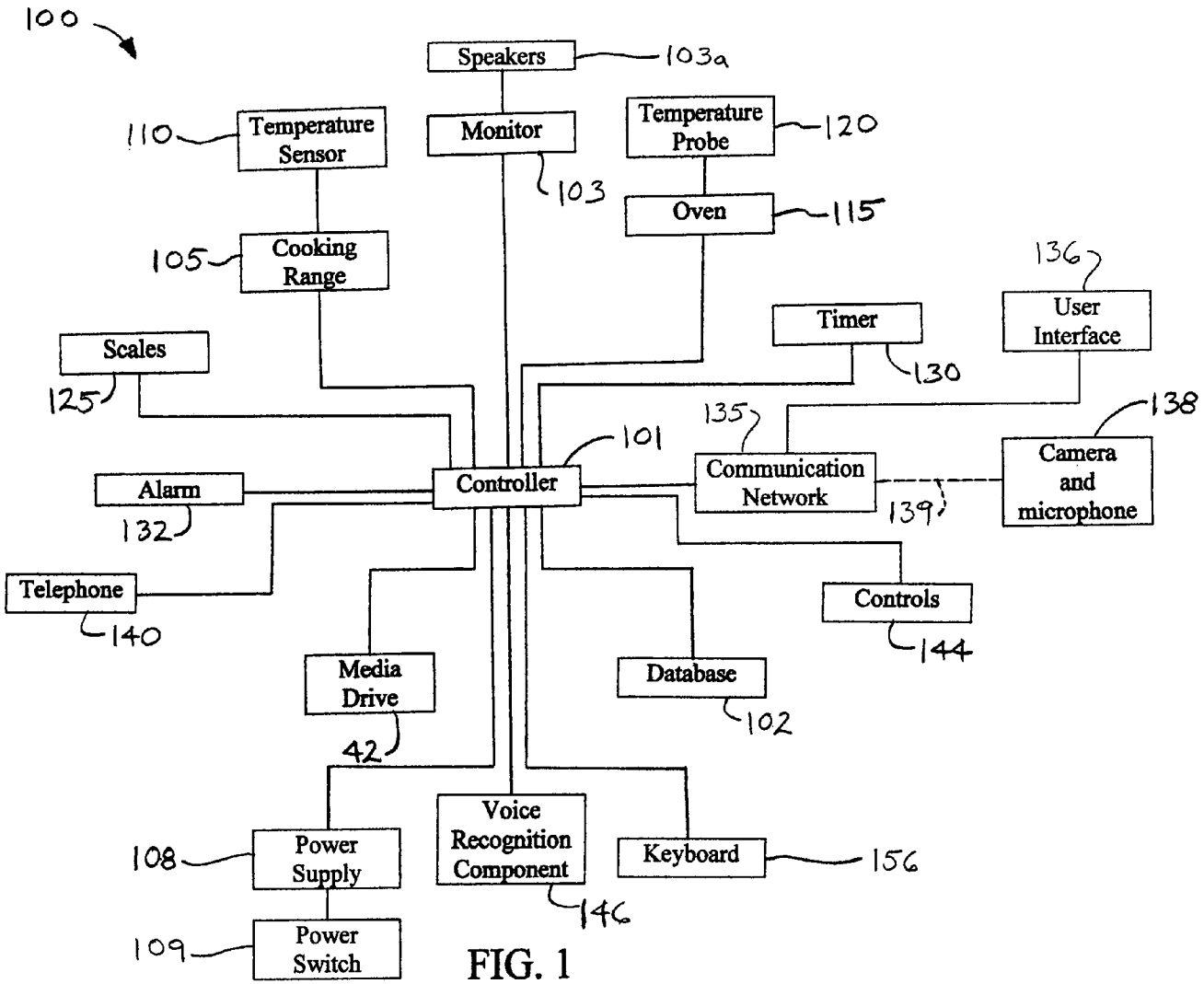
FIG. 1 is a block diagram of an illustrative embodiment of the programmable cooking system.

Referring initially to FIG. 1 of the drawings, an illustrative embodiment of the programmable cooking system, hereinafter system, is generally indicated by reference numeral 100. The system 100 may include a controller 101 having a database 102. The database 102 may be adapted to store, in a digital format, one or more recipes which relate to the preparation of one or more foods, for example and without limitation. The database 102 may additionally be adapted to store one or more cooking instructions which are entered into the database 102 by a user (not illustrated), as will be hereinafter described. A display monitor 103 having at least one speaker 103*a* may interface with the controller 101. The controller 101 may be adapted to display one or more recipes on the display monitor 103 for the preparation of food according to the recipe or recipes. The controller 101 may additionally be adapted to broadcast audio signals which relate to preparation of the food through the speaker or speakers 103*a*, as will be hereinafter described.

A power supply 108 may interface with the controller 101. The power supply 108 may be a 120-volt household supply of electrical power or any other source of electrical power which is suitable to operate the various components of the system 100. A power switch 109 may interface with the power supply 108 to facilitate selective flow of electrical power to the various elements of the system 100 via the controller 101.

At least one cooking range 105 may interface with the controller 101. The controller 101 may be adapted to operate the cooking range 105 at a temperature or heat setting and for a time required by a recipe and/or cooking instructions that have been entered into the database 102. A temperature sensor 110 may be provided in thermally-conductive contact with a selected component or components of the cooking range 105 and may interface with the controller 101 to measure temperatures of the cooking range 105 and indicate the measured temperatures to the controller 101, as will be hereinafter described.

At least one oven 115 may interface with the controller 101. The controller 101 may be adapted to operate the oven 115 at a temperature or heat setting and for a time required by a recipe and/or cooking instructions that have been entered into the database 102. A temperature probe 120 may be provided in the oven 115 and may interface with the controller 101 to measure temperatures inside the oven 115 and indicate the measured temperatures to the controller 101, as will be hereinafter described. Scales 125, each of which may be digital scales, may interface with the controller 101 and may be adapted to weigh food ingredients (not illustrated) which are placed in a cooking vessel (not illustrated) on the cooking range 105 and/or in the oven 115, as will be hereinafter described. A timer 130 may interface with the controller 101 and may be adapted to time the cooking of foods on the cooking range 105 and/or in the oven 115, as will be hereinafter described. An alarm 132 may interface with the controller 101 and may be adapted to indicate excessive heat, spills and/or other undesirable conditions on the cooking range 105 and/or in the oven 115 to the controller 101.

In some embodiments, a communication network 135 may interface with the controller 101. A camera and microphone 138 may be adapted to capture video images and audio signals, respectively, and transmit these as audiovisual signals 139 to the communication network 135. The communication network 135, in turn, may be adapted to electronically transmit audio and video data which corresponds to the audiovisual signals 139 to the controller 101. The communication network 135 may be the Internet, a cellular telephone network, a satellite network, a closed loop network and/or any other type of communication network which is capable of receiving the audiovisual signals 139 from the camera and microphone 138 and electronically transmitting the corresponding audio and video data to the controller 101.

In some applications, the camera and microphone 138 may capture video images and audio signals of a chef (not illustrated) as the chef provides instruction on the preparation of food and the system 100 may be operated to cook the food according to the chef's instructions. The camera and microphone 138 may transmit the captured audio signals and video images to the communication network 135 via the audiovisual signals 139. The communication network 135 may transmit audio and video data which correspond to the audiovisual signals 139 to the controller 101. In some applications, the controller 101 may display the video images of the chef in a live format on the display monitor 103 and broadcast the verbal instructions of the chef, which correspond to the audio signals, through the speaker or speakers 103*a*. In other applications, the controller 101 may record the video images and the audio signals of the chef in the database 102. The controller 101 may be adapted to display the recorded video images of the chef on the display monitor 103 and broadcast the recorded audio signals of the chef's verbal instructions through the speakers 103*a* at a selected time via user control at a user interface 136 or a keyboard 156 (each of which is described herein below). In either case, the controller 101 may be adapted to control the cooking range 105 or the oven 115 at times and temperatures or heat settings (cooking parameters) which are dictated by the chef. In some applications, this may be accomplished by the user's entry of the cooking parameters into the database 102 using the telephone 140, the media drive 142, the keyboard 156 or the user interface 136. In other applications, the cooking parameters may be encoded in the audiovisual signals 139 and recognized by the controller 101 to enable the controller 101 to operate the cooking range 105 or the oven 115 according to the cooking parameters, per the chef's instructions. Other techniques known by those skilled in the art may be used to enable the controller 101 to automatically operate the cooking range 105 and the oven 115 according to the chef's instructions.

In some embodiments, a user interface 136 may interface with the communication network 135. The user interface 136 may be a computer, cell phone or other wired or wireless communication device. Accordingly, the user interface 136 may enable a user (not illustrated) of the system 100 to remotely transmit a recipe and/or cooking instructions to the controller 101 and database 102 via the Internet (such as via email) or other communication network 135, as will be hereinafter further described.

In some embodiments, at least one telephone 140 may interface with the controller 101. The telephone 140 may be adapted to enter cooking instructions and the like into the database 102 via the controller 101. In some embodiments, the telephone 140 may include at least one ground or "land line" telephone and/or at least one cellular telephone or other wireless communication device which may be connected to the controller 101 via a suitable communication network (not illustrated).

At least one media drive 142 may interface with the controller 101 for the purpose of entering recipes and/or other data into the database 102 via the controller 101. The media drive 142 may include a disk drive, a USB port and/or any other type of drive or port which is suitable for uploading data from a computer-readable medium (not illustrated) into the database 102. The media drive 142 may additionally include whichever control features (not illustrated) may be necessary to upload the data from the computer-readable medium into the database 102. The controller 101 may be adapted to display information such as upload instructions and/or upload progress on the display monitor 103 as the data is uploaded into the database 102 via the media drive 142.

In some embodiments, a voice recognition component 146 may interface with the controller 101. The voice recognition component 146 may be include conventional hardware and software which are adapted to convert spoken verbal cooking instructions and/or recipes into a digital data format that may be entered into the database 102 via the controller 101, according to the knowledge of those skilled in the art. A keyboard 156 may interface with the controller 101 for the purpose of manually entering cooking instructions and/or recipes into the database 102 and/or editing the cooking instructions and/or recipes stored in the database 102.

Conventional controls 144 for the cooking range 105 and/or the oven 115 may interface with the controller 101. The conventional controls 144 may facilitate direct control over the cooking range 105 and/or the oven 115 using conventional control mechanisms known by those skilled in the art. In some embodiments, the conventional controls 144 may bypass the controller 101 and may be hard-wired into the circuitry (not illustrated) of the cooking range 105 and/or the oven 115. In some embodiments, the conventional controls 144 may provided an override to operation of the cooking range 105 and the oven 115 by the controller 101.

Figure 2:
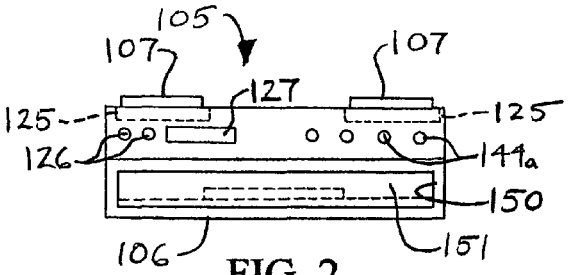
FIG. 2 is a front view of a cooking range of an illustrative embodiment of the programmable cooking system.
Figure 4:
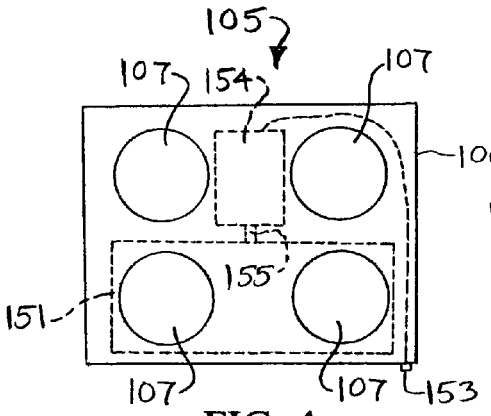
FIG. 4 is a top view of the cooking range of an illustrative embodiment of the programmable cooking system, more particularly illustrating a keyboard support (illustrated in phantom) retracted into the range.
Figure 5:
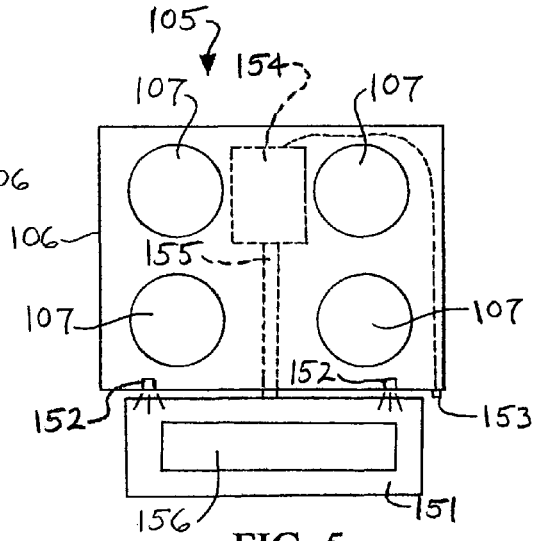
FIG. 5 is a top view of the cooking range of an illustrative embodiment of the programmable cooking system, with the keyboard support extended from the range and a keyboard provided on the keyboard support.

Referring next to FIGS. 2, 4 and 5 of the drawings, the cooking range 105 of the system 100 may include a cooking range housing 106 which may have any desired size and shape. At least one cooking range burner 107 may be provided on the cooking range housing 106. As illustrated in FIGS. 4 and 5, in some embodiments four cooking range burners 107 may be provided on the cooking range housing 106 in any suitable pattern. In other embodiments, a greater or lesser number of cooking range burners 107 may be provided on the cooking range housing 106. Each cooking range burner 107 may be gas or electric.

Each cooking range burner 107 of the cooking range 105 may be connected to the controller 101 (FIG. 1) of the system 100 for automated control by the controller 101, as will be hereinafter described. In some embodiments, cooking range controls 144*a* may be provided on the cooking range burner 107 to facilitate manual operation of each cooking range burner 107 at a desired temperature setting. The cooking range controls 144*a* may include conventional controls such as dials and/or buttons, for example and without limitation. In some embodiments, the cooking range controls 144*a* may be connected to the controller 101 to facilitate user control of the cooking range burners 107 through the controller 101. In other embodiments, the cooking range controls 144*a* may bypass the controller 101 for direct control of the cooking range burners 107.

At least one set of scales 125 may be provided on the cooking range housing 106. Each cooking range burner 107 may be provided on a corresponding set of scales 125. Scale controls 126 may be provided on the cooking range housing 105 and connected to each set of scales 125 for the purpose of calibrating each set of scales 125 for weight measurement. A scale display 127 may be provided on the cooking range housing 106. Accordingly, the scales 125 may be adapted to measure the weight of food ingredients (not illustrated) which are provided in a cooking vessel (not illustrated) placed on the cooking range burner 107. The scale display 127 may be adapted to display the measured weight of the food ingredients. The scale controls 126 may be adapted to calibrate the scales 125 prior to use, typically in the conventional manner.

As illustrated in FIG. 2, a generally elongated keyboard slot 150 may be provided in the front of the cooking range housing 106. A keyboard support 151 may be selectively extendable from and retractable in the cooking range housing 106 through the keyboard slot 150 according to any suitable technique which is known by those skilled in the art. As illustrated in FIG. 5, the keyboard support 151 may be adapted to support the keyboard 156 of the system 100. As illustrated in FIGS. 4 and 5, a keyboard support extension motor 154 (illustrated in phantom) may be provided in the cooking range housing 106. A keyboard support extension arm 155 may be selectively extendable from the keyboard support extension motor 154. The keyboard support extension arm 155 may engage the keyboard support 151. A keyboard support extension button 153 may be connected to the keyboard support extension motor 154. The keyboard support extension button 153 may be provided on the exterior surface of the cooking range housing 106 or in any other suitable location. Accordingly, depression of the keyboard support extension button 153 may facilitate extension of the keyboard support 151 from the cooking range housing 106 through the keyboard slot 150 as the keyboard support extension arm 155 is extended from the keyboard support extension motor 154. Subsequent depression of the keyboard support extension button 153 may facilitate retraction of the keyboard support 151 back into the cooking range housing 106 through the keyboard slot 150 as the keyboard support extension arm 155 is retracted into the keyboard support extension motor 154. Alternative techniques known by those skilled in the art may be used to facilitate extension and retraction of the keyboard support 151 with respect to the cooking range housing 106 through the keyboard slot 150. In some embodiments, at least one keyboard light 152 may be provided on the cooking range housing 106 and positioned to illuminate the keyboard support 151 when the keyboard support 151 is extended from the cooking range housing 106.

Figure 3:
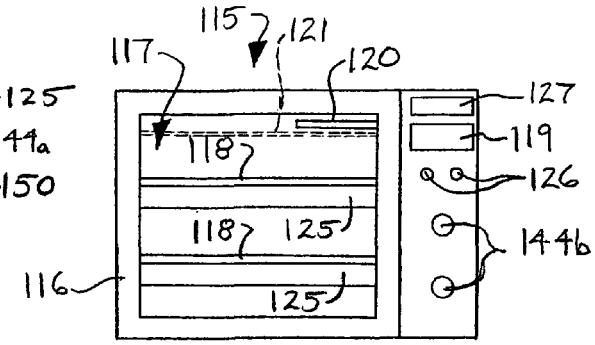
FIG. 3 is a front view of an oven of an illustrative embodiment of the programmable cooking system.

Referring next to FIG. 3 of the drawings, the oven 115 may include an oven housing 116 having an oven housing interior 117. An oven door 119*a* (FIG. 6) may be provided on the oven housing 116 to close the oven housing interior 117. At least one heating element 121 (illustrated in phantom) may be provided in the oven housing interior 117. The temperature probe 120 may be provided in the oven housing interior 117 to measure the temperature of the oven housing interior 117. At least one oven rack 118 may be selectively extendable from the oven housing interior 117. In some embodiments, a pair of upper and lower oven racks 118, as illustrated, may be selectively extendable from the oven housing interior 117. Each oven rack 118 may be adapted to support at least one cooking vessel (not illustrated).

A set of scales 125 may be provided on each oven rack 118 to measure the weight of food ingredients (not illustrated) placed in the cooking vessel. A scales display 127 may be provided on the exterior of the oven housing 116 and connected to each set of scales 125 to indicate the weight of the ingredients provided in the cooking vessel which is placed on the oven rack 118. In some embodiments, oven controls 144*b* may be provided on the oven housing 116 to facilitate manual operation of the heating element or elements 121 at a desired temperature setting. The oven controls 144*b* may include conventional controls such as dials and/or buttons, for example and without limitation. In some embodiments, the oven controls 144*b* may be connected to the controller 101 to facilitate user control of the heating element or elements 121 through the controller 101. In other embodiments, the oven controls 144*b* may bypass the controller 101 for direct control of the heating element or elements 121. An oven display 119 may be provided on the exterior of the oven housing 116 and connected to the temperature probe 120 and the oven controls 144*b*. The oven display 119 may be adapted to display the set temperature which is established by the user via the oven controls 144*b* and the actual temperature of the oven interior 117 as measured by the temperature probe 120.

Figure 6:
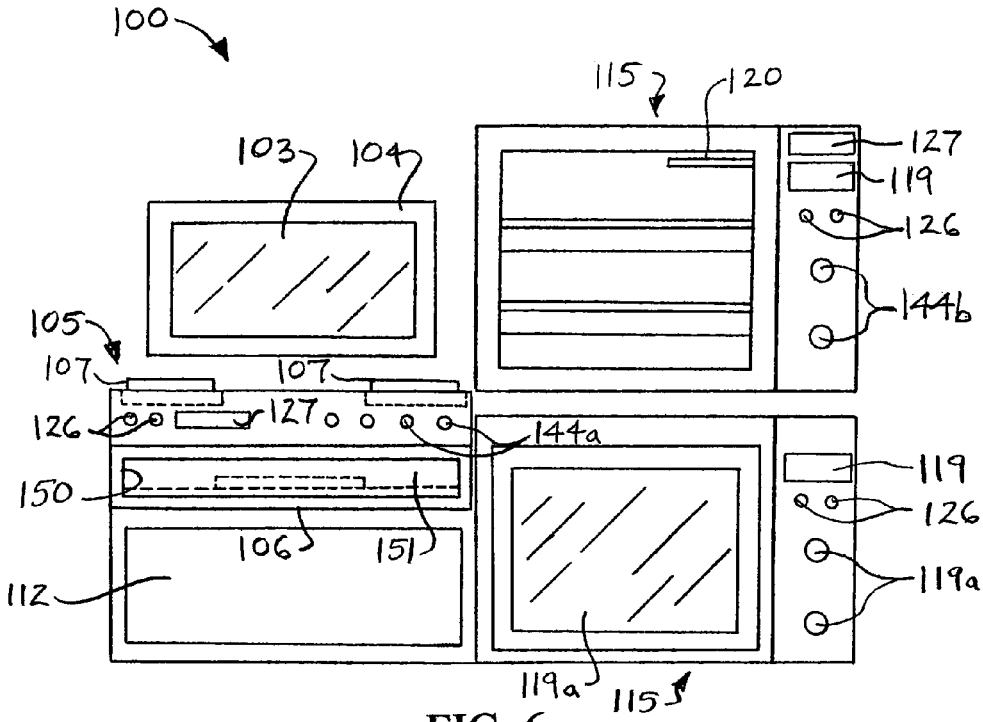
FIG. 6 is a front view of an illustrative embodiment of the programmable cooking system, more particularly illustrating an exemplary arrangement of the cooking range, oven and other components of the system.

Referring next to FIG. 6, an exemplary arrangement of the various components of the system 100 is illustrated. Accordingly, the cooking range 105 may be arranged generally adjacent to at least one oven 115. In some embodiments, the cooking range 105 may be arranged generally adjacent to a pair of upper and lower ovens 115, as illustrated. The display monitor 103 may be positioned generally above the cooking range 105, as illustrated, or in some other suitable location. In some embodiments, a cabinet or other storage space 112 may be disposed beneath the cooking range 105 for storage of cooking equipment or utensils (not illustrated). In other embodiments, an oven 115 may be disposed beneath the cooking range 115. In FIG. 6, the oven door 119*a* of the upper oven 115 is omitted to illustrate the oven housing interior 117.

Figure 7:
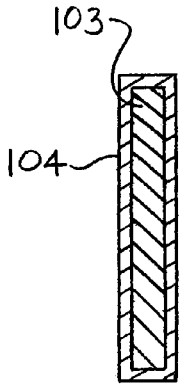
FIG. 7 is a cross-sectional view of a monitor enclosed in a monitor enclosure according to an illustrative embodiment of the programmable cooking system.

Referring next to FIG. 7, a cross-sectional view of a display monitor 103 which is suitable for implementation of the system 100 is illustrated. In some embodiments, the display monitor 103 may be encased in a transparent monitor enclosure 104 which may be glass or plastic. The monitor enclosure 104 may protect the display monitor 103 from heat as well as grease and other cooking solids or liquids which may be inadvertently ejected from a cooking vessel (not illustrated) heated on one of the cooking range burners 107 of the cooking range 105 during operation of the system 100.

Referring again to FIGS. 1 and 2, 4 and 5 of the drawings, exemplary implementation of the system 100 using the cooking range 105 may be as follows. A recipe which directs the preparation of a food item (not illustrated) that is to be prepared on the cooking range 105 may initially be entered into the database 102 using any of a variety of methods. In some applications, the recipe may be entered into the database 102 using the keyboard 156. Accordingly, the keyboard support extension button 153 (FIGS. 4 and 5) may be depressed to extend the keyboard support 151, and the keyboard 156 supported thereon, from the cooking range housing 106 through the keyboard slot 150 (FIG. 2). The keys (not illustrated) on the keyboard 156 may be used to enter the recipe into the database 102. As it is entered into the database 102, the controller 101 may display the recipe on the display monitor 103.

In other applications, the recipe may be entered into the database 102 by uploading the recipe from a computer-readable medium (not illustrated) which is inserted in the media drive 142. The upload progress of the recipe may be displayed on the display monitor 103. In still other applications, the recipe may be entered into the database 102 by speaking the recipe into the voice recognition component 146. In other applications, the recipe may be entered into the database 102 using the user interface 136 via the communication network 135. For example, in some applications the recipe may be entered into the database 102 via email.

As it is entered into the database 102, the controller 101 may display the recipe on the display monitor 103. In some applications, the recipe may be stored in the database 102 such that a user (not illustrated) can edit the recipe using the voice recognition component 146, the keyboard 156 and/or the user interface 136. In other applications, the recipe may be stored in the database 102 in a read-only format to prevent edits or changes from being made to the recipe after it is stored in the database 102.

A cooking vessel (not illustrated) may be placed on one of the cooking range burners 107 of the cooking range 105. Food ingredients (not illustrated) may be individually placed in the cooking vessel and weighed to obtain the quantities which are required by the recipe using the scales 125 beneath each cooking range burner 107. The weight of each ingredient may be indicated on the scale display 127 (FIG. 2) as it is placed in the cooking vessel. Prior to placement of each ingredient in the cooking vessel, the scales 125 beneath the cooking range burner 107 may be calibrated or "zeroed" using the scale controls 126 (FIG. 2) to erase the weighed quantity of the previous ingredient which was displayed on the scale display 127. In this manner, the user may accurately place the correct quantity of each ingredient in the cooking vessel as required by the recipe. Liquid ingredients (not illustrated) may be volumetrically measured for placement in the cooking vessel using a suitable volume-measuring device (not illustrated) typically in the conventional manner. Alternatively, the liquid ingredients may be indicated by weight rather than volume in the recipe, in which case the measured liquid ingredients are placed in the cooking vessel according to weight as required by the recipe. Therefore, as it is added to the cooking vessel, the weight of each liquid ingredient may be indicated on the scale display 127.

After the ingredients have been placed in the cooking vessel in the measured quantities which are required by the recipe, the user may enter cooking instructions which are indicated by the recipe into the database 102. The cooking instructions may include the time which is selected by the user to initiate cooking of the ingredients, for example and without limitation. The cooking instructions may be entered into the database 102 using the telephone 140, the media drive 142, the voice recognition component 146, the keyboard 156 and/or the user interface 136 via the communication network 135.

The controller 101 initiates cooking of the ingredients in the cooking vessel at the time which was indicated in the cooking instructions previously entered into the database 102 by the user. Accordingly, the controller 101 automatically facilitates flow of electrical current to the cooking range burner 107 on which the cooking vessel was placed until the cooking range burner 107 reaches the temperature or heat setting which is indicated by the recipe. Via input from the timer 130, the controller 101 automatically maintains the temperature or heat setting of the cooking range burner 107 for the period of time which is required by the recipe. In some cases, the recipe may require that the ingredients in the cooking vessel be stirred or that additional ingredients be added to the cooking vessel at particular times during the course of cooking the food. Therefore, the controller 101 may include the capability to implement audible and/or visible reminders, such as via the speakers 103*a* and/or the monitor 103, to stir the ingredients or add the additional ingredients to the cooking vessel at the times which are required by the recipe. In the event that the ingredients begin to burn or a spill occurs on the cooking range 105 at any time during the course of cooking the food, the temperature sensor 110 may detect burning or spilling of the ingredients and cause the controller 101 to automatically and immediately terminate further operation of the cooking range 105. The controller 101 may additionally activate the alarm 132 to notify the user that overheating or a spill has occurred.

After the time which is required by the recipe for cooking the ingredients in the cooking vessel has expired as determined by the timer 130, the controller 101 may automatically terminate further operation of the cooking range burner 107. The controller 101 may include the capability to implement an audible and/or visible indication, such as via the speakers 103*a* and/or the monitor 103, that cooking of the ingredients in the cooking vessel has ceased. The cooking vessel may then be removed from the cooking range burner 107 and the cooked food removed from the cooking vessel and consumed. Alternatively, additional preparation steps which are called for by the recipe may be carried out prior to consumption of the food. At any time during cooking of the food, the conventional controls 144 may be used to override operation of the cooking range 105 by the controller 101.

Referring again to FIGS. 1 and 3 of the drawings, exemplary implementation of the system 100 using the oven 115 may be as follows. A recipe which directs the preparation of a food item (not illustrated) that is to be prepared in the oven 115 may initially be manually entered into the database 102 typically using the keyboard 156, by uploading the recipe from a computer-readable medium (not illustrated) which is inserted in the media drive 142, by speaking the recipe into the voice recognition component 146 or by entering the recipe into the database 102 using the user interface 136 via the communication network 135.

After the recipe is entered into the database 102, the controller 101 may display the recipe on the display monitor 103. In some applications, the recipe may be stored in the database 102 such that a user (not illustrated) can edit the recipe using the voice recognition component 146, the keyboard 156 and/or the user interface 136. In other applications, the recipe may be stored in the database 102 in a read-only format to prevent edits or changes from being made to the recipe after it is stored in the database 102.

Next, one of the oven racks 118 may be extended from the oven housing interior 117 and a cooking vessel (not illustrated) may be placed on the extended oven rack 118. Food ingredients (not illustrated) may be individually placed in the cooking vessel and weighed using the scales 125 beneath each oven rack 118. The weight of each ingredient may be indicated on the scale display 127 (FIG. 2) as it is placed in the cooking vessel. Prior to placement of each ingredient in the cooking vessel, the scales 125 beneath the oven rack 118 may be calibrated or "zeroed" using the scale controls 126 (FIG. 2) to erase the weighed quantity of the previous ingredient which was displayed on the scale display 127. In this manner, the user may accurately place the correct quantity of each ingredient in the cooking vessel as required by the recipe. Liquid ingredients (not illustrated) may be volumetrically measured using a suitable volume-measuring device (not illustrated) typically in the conventional manner. Alternatively, the liquid ingredients may be indicated by weight rather than volume in the recipe, in which case the measured liquid ingredients are placed in the cooking vessel according to weight as required by the recipe. Therefore, as it is added to the cooking vessel, the weight of each liquid ingredient is indicated on the scale display 127. After the ingredients have been placed in the cooking vessel in the measured quantities which are required by the recipe, the user may enter cooking instructions into the database 102 such as by using the telephone 140, the media drive 142, the voice recognition component 146, the keyboard 156 and/or the user interface 136 via the communication network 135.

The controller 101 initiates cooking of the ingredients in the cooking vessel at the time which was indicated in the cooking instructions previously entered into the database 102 by the user. Accordingly, the controller 101 automatically facilitates flow of electrical current from the power supply 108 to the heating element or elements 121 (FIG. 3) in the oven housing interior 117 to heat the oven housing interior 117 to the temperature which is indicated by the recipe. Via input from the timer 130, the controller 101 automatically maintains the temperature of the oven housing interior 117 for the period of time which is required by the recipe. In some cases, the recipe may require that the ingredients in the cooking vessel be stirred or that additional ingredients be added to the cooking vessel at particular times during the course of cooking the food. Therefore, the controller 101 may implement audible and/or visible reminders, such as via the speakers 103*a* and/or the monitor 103, to stir the ingredients or add the additional ingredients to the cooking vessel at the times which are required by the recipe.

After the time which is required by the recipe for cooking the ingredients in the cooking vessel has expired as determined by the timer 130, the controller 101 may automatically terminate further operation of the heating element or elements 121. The controller 101 may include the capability to implement an audible and/or visible indication, such as via the speakers 103*a* and/or the monitor 103, that cooking of the ingredients in the cooking vessel has ceased. The oven rack 118 on which the cooking vessel rests may then be extended from the oven housing interior 117, the cooking vessel may be removed from the oven rack 118 and the cooked food removed from the cooking vessel and consumed. Alternatively, additional preparation steps which are called for by the recipe may be carried out prior to consumption of the food. At any time during cooking of the food, the conventional controls 144 may be used to override operation of the oven 115 by the controller 101.

Referring again to FIG. 1 of the drawings, the system 100 may be implemented using the cooking range 105 or the oven 115 under guidance from a chef (not illustrated) either in a live format or a recorded format. Accordingly, the camera and microphone 138 may capture video images and verbal instructions, respectively, of the chef as the chef provides instruction on preparing a selected recipe. The video images and verbal instructions which are captured by the camera and microphone 138 are transmitted in the form of audiovisual signals 139 to the communication network 135. The communication network 135, in turn, may transmit audio and video data which correspond to the audiovisual signals 139 to the controller 101.

In some applications, the controller 101 may display the video images of the chef in a live format on the display monitor 103 and broadcast the verbal instructions of the chef, which correspond to the audio signals, through the speaker or speakers 103*a* in real time. In other applications, the controller 101 may record the video images and the audio signals of the chef in the database 102. At a selected time, a user (not illustrated), typically via the user interface 136 or the keyboard 156, may operate the controller 101 such that the controller 101 displays the recorded video images of the chef on the display monitor 103 and broadcasts the recorded audio signals of the chef's verbal instruction through the speakers 103*a*. Therefore, as the chef directs, the user places the cooking vessel on a range top burner 107 (FIGS. 2, 4 and 5) of the cooking range 105 or on one of the oven racks 118 (FIG. 3) of the oven 115 and places the ingredients in the quantities which are required by the recipe, per the chef's instructions, into the cooking vessel as the scales 125 individually weigh the ingredients. The controller 101 may then automatically operate the cooking range 105 or the oven 115 to cook the ingredients for a time and at a temperature or heat setting which accords with the chef's instructions. When the time period for cooking the ingredients expires, the controller 101 may automatically terminate further operation of the cooking range 105 or the oven 115 and the cooked food may be consumed or further prepared for consumption. In some applications, the user may manually control operation of the cooking range 105 or the oven 115 using the conventional controls 144 according to the chef's instructions.

Figure 8:
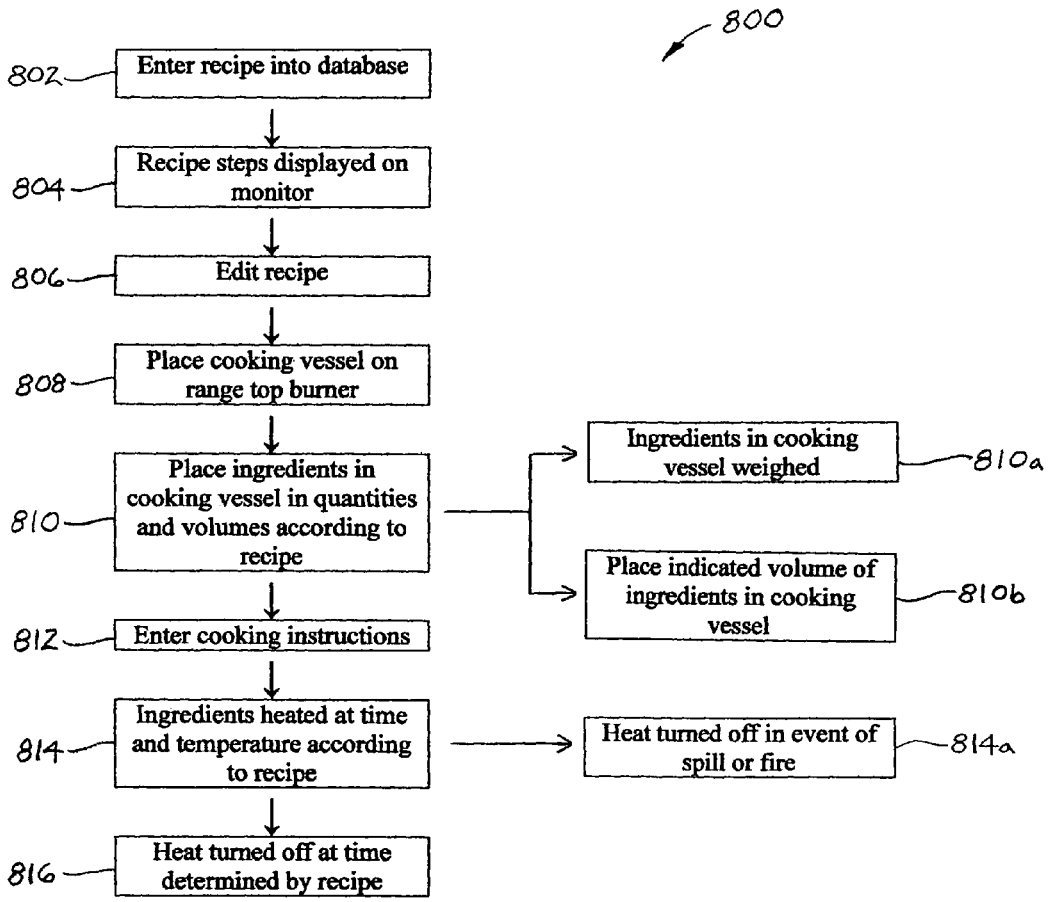
FIG. 8 is a flow diagram of an illustrative embodiment of a programmable cooking method using a cooking range.

Referring next to FIG. 8 of the drawings, a flow diagram 800 of an illustrative embodiment of a programmable cooking method using a cooking range is illustrated. The method may be used in implementation of the cooking range 105 of the system 100 which was heretofore described with respect to FIGS. 1-7. In block 802, a recipe may be entered into a database. In block 804, the recipe steps of the recipe entered into the database may be displayed on a display monitor. In block 806, the recipe may be edited. In block 808, a cooking vessel may be placed on a range top burner. In block 810, ingredients may be placed in the cooking vessel in quantities and volumes according to the recipe. This may include weighing the ingredients in the cooking vessel in block 810*a* and placing an indicated volume of ingredients in the cooking vessel in block 810*b*. In block 812, cooking instructions may be entered into the database. In block 814, the ingredients may be automatically heated at a time and temperature according to the recipe via a controller interfacing with the database. In block 814*a*, the controller may automatically turn the heat off in the event of a spill or fire. In block 816, the controller may automatically turn the heat off at a time which is determined by the recipe.

Figure 9:
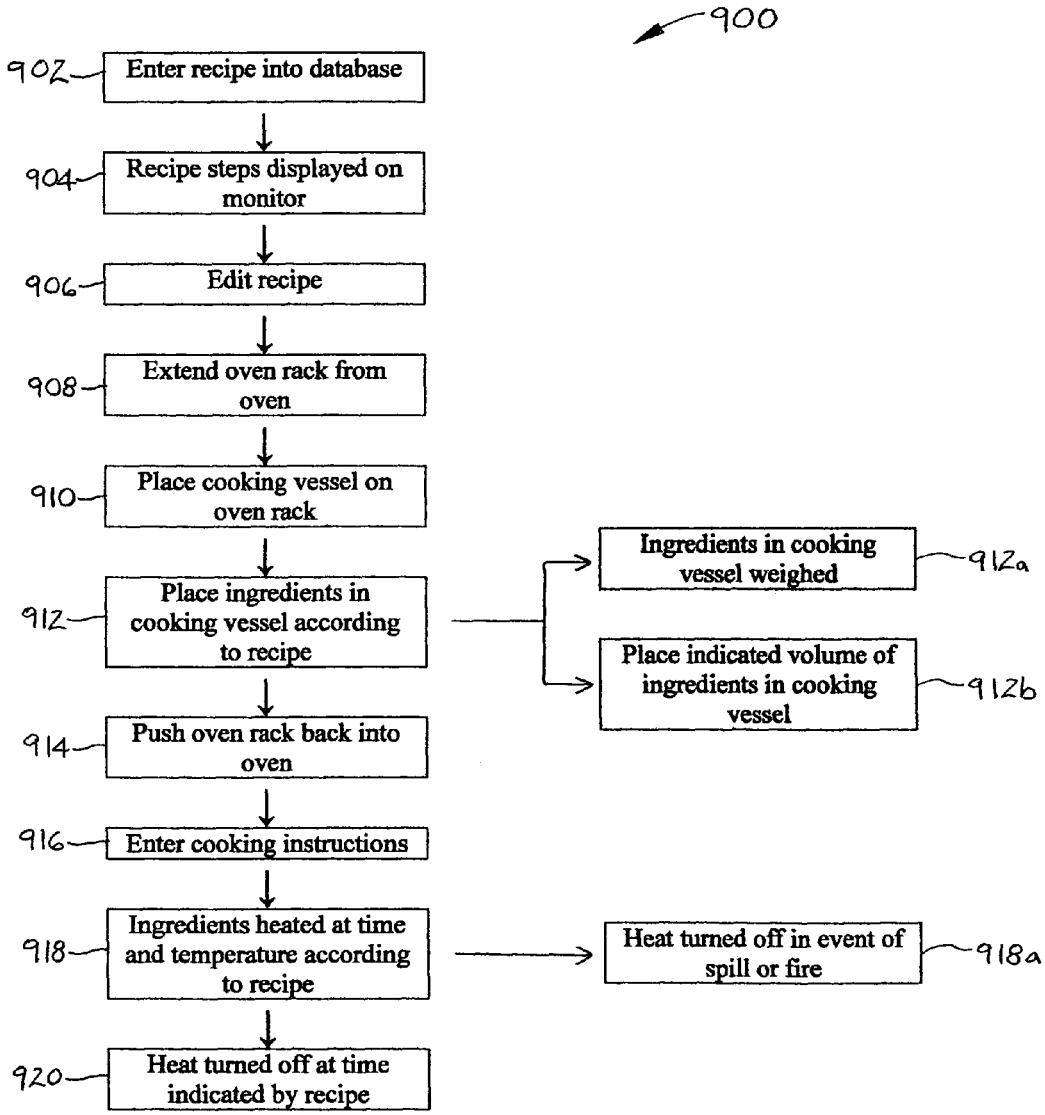
FIG. 9 is a flow diagram of an illustrative embodiment of a programmable cooking method using an oven.

Referring next to FIG. 9 of the drawings, a flow diagram 900 of an illustrative embodiment of a programmable cooking method using an oven is illustrated. The method may be used in implementation of the oven 115 of the system 100 which was heretofore described with respect to FIGS. 1-7. In block 902, a recipe may be entered into a database. In block 904, the recipe steps of the recipe entered into the database may be displayed on a display monitor. In block 906, the recipe may be edited. In block 908, an oven rack may be extended from the oven. In block 910, a cooking vessel may be placed on the oven rack. In block 912, ingredients may be placed in the cooking vessel in quantities and volumes according to the recipe. This may include weighing the ingredients in the cooking vessel in block 912*a* and placing an indicated volume of ingredients in the cooking vessel in block 912*b*. In block 914, the oven rack may be pushed back into the oven. In block 916, cooking instructions may be entered into the database. In block 918, the ingredients may be automatically heated at a time and temperature according to the recipe via a controller interfacing with the database. In block 918*a*, the controller may automatically turn the heat off in the event of a spill or fire. In block 920, the controller may automatically turn the heat off at a time which is determined by the recipe.

Figure 10:
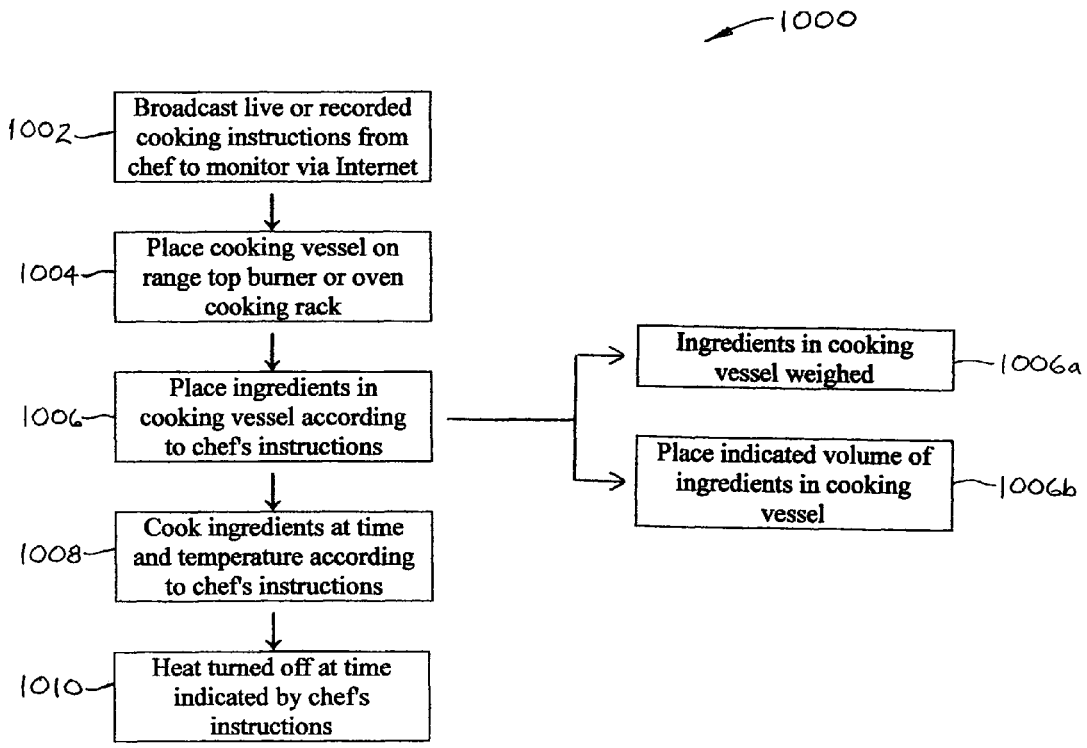
FIG. 10 is a flow diagram of an illustrative embodiment of a programmable cooking method according to live or recorded cooking instructions from a chef.

Referring next to FIG. 10 of the drawings, a flow diagram 1000 of an illustrative embodiment of a programmable cooking method using a cooking range or an oven according to live or recorded cooking instructions from a chef is illustrated. The method may be used in implementation of the cooking range 105 or the oven 115 of the system 100 which was heretofore described with respect to FIGS. 1-7. In block 1002, live or recorded cooking instructions may be broadcast from the chef to a display monitor via the Internet or other communication network. In block 1004, a cooking vessel may be placed on a range top burner or an oven cooking rack. In block 1006, food ingredients may be placed in the cooking vessel according to the chef's instructions. This may include weighing the ingredients in the cooking vessel in block 1006*a* and placing an indicated volume of ingredients in the cooking vessel in block 1006*b*. In block 1008, the ingredients may be automatically cooked at a time and temperature according to the chef's instructions via operation of a controller. In block 1010, the controller may automatically turn the heat off at a time which is determined by the chef's instructions.

While the illustrative embodiments of the disclosure have been described above, it will be recognized and understood that various modifications can be made in the disclosure and the appended claims are intended to cover all such modifications which may fall within the spirit and scope of the disclosure.

What is claimed is:

1. A programmable cooking system, comprising:
- a controller having a database;
- a display monitor interfacing with said controller;
- a cooking range comprising:
  - a cooking range housing having a keyboard slot;
  - a keyboard support selectively extendable from said cooking range housing through said keyboard slot;
  - a keyboard interfacing with said controller and carried by said keyboard support;
  - at least one set of scales carried by said cooking range housing and interfacing with said controller; and
  - at least one cooking range burner carried by said at least one set of scales, respectively, and connected to said controller;
- an oven comprising:
  - an oven housing having an oven housing interior;
  - at least one oven rack selectively extendable from said oven housing interior;
  - at least one set of scales carried by said at least one oven rack and interfacing with said controller; and
  - at least one heating element provided in said oven housing interior and connected to said controller;
- a timer interfacing with said controller; and
- at least one of a media drive and a communication network having a user interface interfacing with said controller.

2. The system of claim 1 wherein at least one of a media drive and a communication network comprises a communication network and further comprising a camera and microphone disposed in communication with said communication network.

3. The system of claim 1 further comprising a telephone interfacing with said controller.

4. The system of claim 1 further comprising conventional controls connected to said at least one cooking range burner and said at least one heating element.

* * * * *